United States Patent [19]

Langley

[11] Patent Number: 4,512,866

[45] Date of Patent: Apr. 23, 1985

[54] TITANIUM-LEAD ANODE FOR USE IN ELECTROLYTIC PROCESSES EMPLOYING SULFURIC ACID

[76] Inventor: Robert C. Langley, 214 Old Forge Rd., Millington, N.J. 07946

[21] Appl. No.: 538,799

[22] Filed: Oct. 4, 1983

[51] Int. Cl.[3] ..... C25B 11/00

[52] U.S. Cl. ..... 204/290 F

[58] Field of Search ..... 204/290 F, 108, 119

[56] References Cited

U.S. PATENT DOCUMENTS

| | | | |
|---|---|---|---|
| 3,691,052 | 9/1972 | Langley | 204/290 F |
| 4,107,025 | 8/1978 | Loutfy et al. | 204/290 F |
| 4,157,943 | 6/1979 | Scarpellino, Jr. et al. | 204/37 R |
| 4,260,470 | 4/1981 | Fisher | 204/290 F |
| 4,279,711 | 7/1981 | Vining et al. | 204/105 R |
| 4,380,493 | 4/1983 | Wortley | 204/290 F |
| 4,426,262 | 1/1984 | Langley | 204/290 F |
| 4,437,969 | 3/1984 | Dreulle | 204/290 F |

OTHER PUBLICATIONS

Horowitz, Horowitz, and Longo, Electro-Organic Oxidations on Lead Ruthenate, National Meeting of Electrochemical Society, Minneapolis, 1981.

*Primary Examiner*—John F. Niebling

*Attorney, Agent, or Firm*—Karl F. Ross; Herbert Dubno

[57] ABSTRACT

An anode for use in electrolytic processes with an electrolyte containing sulfuric acid. The anode comprises a valve metal substrate, a lead or lead alloy antipassivation layer in contact with the valve metal substrate, and a lead ruthenate or lead iridate catalyst in surface contact with the lead or the lead alloy. Also disclosed are methods for employing the anode in electrowinning processes as well as a process for operating an electrolytic cell.

6 Claims, 2 Drawing Figures

TITANIUM-LEAD ANODE FOR USE IN ELECTROLYTIC PROCESSES EMPLOYING SULFURIC ACID

FIELD OF THE INVENTION

This invention relates to a new anode for use in electrolytic processes where the electrolyte contains sulfuric acid. The invention also relates to a method for producing said anode. The anode is useful for electrowinning and electrorefining of copper, zinc, nickel, manganese, cobalt and other metals. It is also useful for electroplating of copper, nickel and chromium onto various substrates to provide decorative or protective coatings.

BACKGROUND OF THE INVENTION

For many years, electrolytic processes have been used to produce copper, zinc, nickel, manganese, cobalt and other metals in high purity. These processes fall into two broad categories, electrowinning and electrorefining. In electrowinning, an ore is leached with an acid to obtain the metal sought in solution. The solution is partially purified by chemcial steps and then introduced into electrolytic cells where the metal is removed in high purity by deposition onto a cathode. Zinc is commonly produced by electrowinning and zinc cells employ lead-silver alloy anodes and aluminum cathodes.

In electrorefining, an ore is smelted to produce a metal as a solid at an intermediate level of purity. The solid metal is then used as the anode in an electrolytic cell and is gradually dissolved under a potential to deposit the metal in high purity on a cathode. Copper is commonly produced in this way, and the molten output of the smelter is cast into anodes which contain 95% Cu. In copper cells these anodes are dissolved to produce pure copper on cathodes which are initially thin sheets of pure copper. During the electrochemical step, impurities in the copper anode do not dissolve in the electrolyte but fall to the bottom of the cell and are recovered. These impurities can include gold, silver and metals of the platinum group and in some ores recovery and subsequent purification of impurities has substantial economic significance. In copper refineries, there are auxiliary banks of electrolytic cells used to produce thin copper starter sheets and to recover metal values from various process streams. These cells use lead-calcium alloy anodes.

About 1975, the mining industry undertook substantial efforts to develop alternative processes to eliminate the smelting step. There were two major reasons for this. In smelting, very large amounts of ore are heated to high temperatures, so fuel consumption is large and cost of fuels was increasing rapidly. Secondly, smelters emit large quantities of pollutants from their stacks. Coal is a common fuel and is the source of some of the pollutants and others (for example, compounds of sulfur, arsenic and tellurium) come from the ore. Major efforts have been made, at great expense, to control smelter pollutants but as a practical matter, they can not be eliminated entirely. In some countries, such as the U.S. and Canada, approval from environmental authorities to continue operation of smelters or to build new smelters, became a serious concern to the industry.

The trend away from smelting caused increased interest in improving electrowinning processes. One area of substantial research was a search for new anodes to replace lead alloy anodes. Particular alloys had evolved over the years as optimum for specific uses, but several disadvantages remained. When a potential is applied to lead anodes in sulfuric acid, oxygen is evolved and lead dioxide forms on the surface of the anode. This lead dioxide coating determines the operating voltage of the anode and this voltage is high compared to platinum sheet or platinum black, widely used anodes in research applications. A surface coating of platinum, or some other electrocatalyst having low oxygen over-potential, on lead anodes would result in power saving and this would justify use of an expensive electrocatalyst provided long service life was obtained.

The lead dioxide coating which forms on lead alloy anodes has long service life when kept continuously under a potential. When power is turned off, however, lead dioxide reacts with sulfuric acid to form lead sulfate. When a potential is again applied, powdery lead sulfate spalls off the anode. Some of this powder is carried by movement of the electrolyte to the cathode where it deposits as impurity. Larger particles of lead sulfate drop to the bottom of the cell and must be periodically removed. This process involves labor costs and loss of production time. These factors are a significant disadvantage of lead alloy anodes.

In addition, the mechanism of loss of surface coating from anodes described in the paragraph above mitigates against use of a low overpotential catalyst coating, even an inexpensive one, on lead alloy anodes. After one or two power interruptions, any surface catalytic coating will be removed as lead sulfate spalls off.

These points were well known to researchers in the electrowinning field and most workers decided to eliminate lead anodes completely. The general approach was to use a valve metal substrate and apply an electrocatalyst to the surface of this substrate. Valve metals are metals such as niobium, tungsten, zirconium, titanium and tantalum and alloys of these metals. When energized as anodes, valve metals quickly form an adherent surface layer of insulating oxide. The corrosion resistance of valve metals is due to this surface layer but this layer must be modified to allow the anode to conduct current. Of the various valve metals, titanium is the least expensive and is most widely available in the form of rod, bar, and sheet of various thickness and titanium is the substrate of choice for electrowinning anodes.

Choice of surface electrocatalyst is governed by the requirements that the catalyst must have low overpotential for oxygen evolution and that it must not dissolve (or dissolve at an extremely low rate) in hot, strong sulfuric acid while passing current. These requirements limited researchers to metals of the platinum groups and compounds of these metals.

At the beginning of prior art research on coated titanium anodes for use in electrowinning, there was substantial information available in the literature on such anodes for use in producing chlorine from brine solutions. Typical of this literature are the teachings of U.S. Pat. Nos. 3,632,498, 3,711,384, 3,491,014, 3,775,284, 3,810,770 and 3,751,296. These references teach that electrocatalysts such as ruthenium oxide or platinum-iridium alloys, when applied by precisely controlled methods to titanium, give anodes having very low overpotential for chlorine evolution and that the anodes exhibit long service life in hot, saturated brine. Utility of these anodes has been well established on large commercial scale and anodes are known to have life of five years or longer when operated at current densities in the range of 200 to 300 Amps per square foot.

Commercially available chlorine anodes which use ruthenium oxide have thin coatings which contain $RuO_2$;$TiO_2$ or $RuO_2$:$Ta_2O_5$ in proportions of approximately 50:50 by weight. Details of processing are proprietary but it is understood that the coatings are formed by application of a solution of precursor compounds of the coating oxide, followed by heating in air to form the oxides in adherent form. Commercial chlorine anodes coated with platinum-iridium are stated to contain these metals in proportion of 70:30 by weight and processing is understood to also involve solution coating and heating.

Over the past decade, ruthenium has sold at only 10 to 20% of the price of platinum or iridium. For this reason some researchers on electrowinning anodes obtained commercially prepared ruthenium oxide on titanium anodes and evaluated them in sulfuric acid, under accelerated conditions. All found that the anodes passivated rapidly and that the mechanism involved rapid dissolution of ruthenium oxide. Typical of this research are the efforts of Loutfy and Ho as described in U.S. Pat. No. 4,107,025. They undertook to overcome the rapid passivation of a $RuO_2$:$Ta_2O_5$ coating by overcoating it with a relatively thick coating of an insoluble metal tungstate combined with $Ta_2O_5$ and a small amount of $RuO_2$ or $IrO_2$. This approach resulted in anodes having long service life, determined in accelerated laboratory tests. However, a large number of coats are necessary and each coat must be fired, so anodes made in this way have substantial labor costs. In addition, anodes which use $IrO_2$ as part or all of the precious metal of these composite coatings have substantial precious metal cost.

Other researchers on electrowinning anodes used a different approach to achieve long service life titanium anodes made with ruthenium oxide as the principal electrocatalyst. Scarpellino, McEwen and Borner describe in U.S. Pat. No. 4,157,943 a composite electrode in which titanium is first coated with a metal of the platinum group, then coated with a co-deposited layer of ruthenium and iridium, and finally coated with a layer of $RuO_2$:$TiO_2$. Electrodes made in this manner are labor intensive as the first and second layers are applied by electroplating, the anode is then heat treated, and the top coat of $RuO_2$:$TiO_2$ is applied in multiple coats from solution and each coat is heat treated. Also, these anodes use substantial amounts of precious metals. The first layer is preferably palladium and the second layer contains iridium in addition to its major component, ruthenium.

Commercially produced anode coatings of Pt:Ir were also evaluated for performance in sulfuric acid, by some researchers. It was found that Pt:Ir coatings wear at a much lower rate than conventional $RuO_2$:$TiO_2$ chlorine anode coatings but that the wear of Pt:Ir coatings is still too high to allow their use in electrowinning, on economic grounds. An evaluation of this type was performed in the course of the research which led to the present invention.

To summarize the prior art in the field of electrowinning anodes, it has been established that coated titanium anodes which have very long service life when evolving chlorine, have short life when evolving oxygen. A substantial research effort has resulted in anodes having acceptable service life in electrowinning. This has been achieved by use of relatively thicker coatings, containing other precious metals in addition to ruthenium and in some cases by use of processing steps different from those used to produce chlorine anodes. Because of multiple processing steps, very substantial labor is required to produce electrowinning anodes.

OBJECTS OF THE INVENTION

It is the principal object of the invention to provide anodes for electrowinning of metals from sulfuric acid solution, which have long service life.

Another object is use of an inexpensive metal to conduct current from the surface electrocatalyst to a titanium substrate.

A further object is to have this inexpensive metal layer also carry a substantial amount of total anode current, thus allowing minimal use of titanium.

An important object of the invention is to provide an anode having much lower material cost than prior art anodes, and to use a method for producing the anode with low input of labor.

Still another object is to provide novel anode designs and anodes which can be repaired in the field when accidentally damaged.

SUMMARY OF THE INVENTION

I have found an anode for use in electrolytic processes with an electrolyte containing sulfuric acid. This anode is resistant to passivation and has an acceptably low overvoltage for electrolytic processes carried out in sulfuric acid.

The new anodes include a core comprising a valve metal substrate, a lead or lead alloy antipassivation layer in contact with the valve metal substrate, and a lead ruthenate or lead iridate catalyst in surface contact with the lead or lead alloy.

Preferably the valve metal may be any of titanium, tantalum, tungsten, niobium, zirconium and alloys thereof. The preferred valve metal is titanium.

The preferred thickness for the valve metal substrate having the lead or lead alloy antipassivation layer bonded to both surfaces thereof is about $\frac{1}{8}$ in. The valve metal core preferably has a thickness of about 0.063 in. Each of the two lead or lead alloy sheets bonded to the valve metal core preferably has a thickness of 0.02 to 0.04 in. The most preferred thickness of the lead or lead alloy sheet is about 0.03 in.

On the surface of the lead or the lead alloy bonded to the valve metal substrate, it is necessary to apply a catalyst which may be either lead ruthenate or lead iridate, preferably lead ruthenate. The catalyst must be in direct surface contact with the lead or lead alloy. In a preferred feature of my invention, a porous cloth made of any available fabric (e.g. cotton) is coated with the lead ruthenate or lead iridate powdered catalyst and the catalyst is held in direct contact with the lead or lead alloy by mechanical means.

Preferred lead alloys include lead-silver which are especially useful in the electrowinning process to produce zinc. Another group of preferred lead alloys are lead-calcium alloys which are wellknown anode materials used in the preparation of copper starter sheets used as cathodes in the electrorefining of metals such as copper.

The anodes are prepared according to the following method. The valve metal such as titanium is preferably buffed with emery to remove surface impurities and the valve metal is then bonded to the lead or lead alloy. One means for bonding the lead or lead alloy to the valve metal is simply by mechanical means such as nuts and bolts, for instance titanium nuts and bolts. However, a preferred way to bond the lead or lead alloy to the valve metal core is by explosion bonding.

Once the lead or lead alloy is bonded to the valve metal substrate, it is necessary to apply the lead ruthenate or lead iridate catalyst to the lead or lead alloy surface. Lead is a malleable metal and has a low melting point, so the lead ruthenate or lead iridate catalyst powder may be attached by forcing it into the lead or lead alloy, such as through the use of metal rollers. Catalytic adherence could also be achieved by heating the lead or lead alloy to its softening point and then bringing the catalyst powder into contact therewith.

The preferred way to contact the catalyst powder with the lead or lead alloy is through the use of the porous cloth mentioned hereinabove. The catalyst powder is applied to one side of the porous cloth, and the catalyst is held in contact with the lead or lead alloy by mechanical means. For instance a metal or plastic frame is provided on which the porous cloth coated with the catalyst is stretched. The metal or plastic frame is attached to the lead or lead alloy sheets. Accordingly the catalyst powder applied to the cloth is held in direct contact with the lead or lead alloy.

There is yet another advantage to the use of the porous cloth. When the anode is used in electrolytic processes in sulfuric acid and there is an interruption in powder, there will be some formation of lead sulfate. Of course the principal advantage to the new anodes in their ability to resist passivation in sulfuric acid systems. Nonetheless, upon an interruption in power, there may be some lead sulfate formation. The porous cloth has the ability to trap any of this lead sulfate so as to prevent contamination of the electrolyte and cell. Periodically one can interrupt the electrolytic process, remove the porous cloth containing spent catalyst and lead sulfate, and replace the cloth with a fresh cloth containing fresh catalyst and no lead sulfate impurities.

The invention further relates to a method of operating an electrolytic cell. The electrolytic cell is used in an electrowinning process to produce a metal in elemental form from the corresponding metal sulfate. The new method is carried out by preparing an anode according to the method described hereinabove. That is a valve metal substrate is provided; a lead or lead alloy antipassivation layer is bonded to the valve metal substrate; and lead ruthenate or lead iridate is applied to the surface of the lead or lead alloy antipassivation layer.

Once the anode is obtained, an electrolytic cell is assembled which comprises besides the anode, a cathode. The anode and cathode are each immersed into an electrolyte solution of the metal sulfate whose metal ions are to be plated out on the cathode in elemental form. An electric current is then passed through the cell and the metal is recovered in elemental form plated on the cathode surface.

Preferably the anode comprises the porous cloth coated with the lead ruthenate or lead iridate catalyst as described hereinabove.

When the porous cloth coated with catalyst is used to contact the lead or lead alloy antipassivation layer and the catalyst becomes spent after operation of the electrolytic cell, one can interrupt the electrowinning process by turning off the electric current, removing the porous cloth coated with spent catalyst, which has been contaminated by lead sulfate formation, and replacing the porous cloth with a fresh porous cloth coated with catalyst. The electric current is then turned on again and the electrowinning is resumed.

The invention further comprises a method of electrowinning a metal from the corresponding metal sulfate in solution. In such a process, an electric current is passed through an electrolytic cell comprising a cathode and the anode according to my invention described hereinabove, in contact with the metal sulfate electrolyte solution. The metal is then recovered in elemental form on the surface of the cathode. The preferred metals to be used in such a process are zinc or copper through any metal capable of undergoing electrolytic deposition may be employed according to the invention.

This invention provides a structural substrate valve metal, preferably titanium, which extends out of the electrolyte and is wired as anode of the cell. Lead or lead alloy sheet is in intimate contact with the valve metal and prevents passivation of the valve metal. This contact is preferably achieved by explosion bonding. An electrically conducting powdered catalyst, preferably lead ruthenate, is coated on porous cloth and the catalyst is held in contact with the lead sheet by mechanical means. The lead sheet provides conduction between catalyst and valve metal substrate. The lead sheet is chosen in appropriate thickness and shape to also provide a substantial portion of anode conduction to the external connection, thus permitting minimal use of the more expensive valve metal. The porous cloth which supports the catalyst also prevents any decomposition products of lead, formed during open circuit conditions, from entering the electrolyte. The design and construction of the anode is such that certain types of damage which occur during use can be repaired at the place of use.

Any of the valve metals or valve metal alloys can be used as substrate in the anode of this invention. At the present time titanium is preferred for reasons of price and availability. Lead or lead alloys can be used in contact with titanium. Certain alloys, such as lead-calcium, have been reported to have corrosion resistance superior to that of pure lead. It is believed that anodes of the design described here lower the corrosion rate of pure lead by the presence of the surface catalyst.

Choice of catalyst powder for practice of this invention is limited by the corrosive environment. For example, it is known that platinum, in the form of wire, has a substantial corrosion rate when operated as anode in sulfuric acid at 60° to 80° C. Because of high surface area, the wear rate of platinum black powder will predictably be much greater than that of platinum wire. Ruthenium oxide powder would be a poor choice based on the rapid wear shown by ruthenium oxide coatings when evolving oxygen. Iridium oxide powder might exhibit long life as it enhanced operating life of composite coatings developed by Loutfy et al and Scarpellino et al, cited above. Iridium oxide was not used in this research as lower cost catalysts were available.

The catalysts of choice for the anode of this invention are lead ruthenate and lead iridate. Of these, lead ruthenate is greatly preferred for reasons of cost. Lead ruthenate contains 28% Ru by weight whereas lead iridate contains 43% Ir. The price of iridium is about ten times the price of ruthenium.

Lead ruthenate is a black compound having the formula $Pb_2Ru_2O_6$ which crystallizes in the pyrochlore structure. It is a good electrical conductor of the metallic type (not a semiconductor). It was first described in the literature and its structure characterized in 1969.

The first application of this compound was described by R. C. Langley in U.S. Pat. No. 3,691,052. It was found useful as an electrocatalyst for chlorine evolution, having overpotential as low as that of $RuO_2$ or Pt:Ir alloy. More recently, other workers have found lead ruthenate an exceptional catalyst for oxygen evolution. (Horowitz, Horowitz and Longo, "Electro-Organic Oxidations on Lead Ruthenate", paper presented to national meeting of the Electrochemical Society, May 12, 1981, Minneapolis). Horowitz et al used lead ruthenate powder as a bulk anode in aqueous alkali for reactions such as oxidation of primary alcohols to acids. Lead ruthenate powder is commercially available or it can be made by solid state reaction as described by Langley, cited above.

When lead ruthenate powder had been selected as preferred catalyst, a number of experiments were made to produce an anode consisting of lead ruthenate firmly bonded directly to titanium. None of these experiments were completely successful; they are summarized in the following sections.

SUMMARY OF PRELIMINARY EXPERIMENTS

In all experiments, titanium used was Grade 2, commerically pure, low iron material. Lead ruthenate powder used in some experiments was made by the chemical precipitation from a caustic solution of sodium ruthenate upon addition of a solution of lead nitrate. It was characterized as pure by X-ray diffraction and surface area was measured as 32 to 36 $m^2/g$ by the BET method. In other experiments, lead ruthenate powder was purchased from Alfa Inorganics (Danvers, Mass.), their catalog number 13490. This material was not characterized as to surface area. It is offered as Electronic Grade and is considered to be of high purity. Powders from both sources performed equally.

Lead ruthenate powder was slurried in n-butanol and brushed on titanium sheets which were prepared conventionally by degreasing, roughening by grit blasting, cleaning with detergent and air drying. No adherence was obtained when samples were fired in air at 450°, 550° and 650° C.

In another group of experiments, various amounts of $TaCl_5$ were dissolved in n-butanol and lead ruthenate powder was then suspended in this solution. When heated to 450° C. or higher in air, $TaCl_5$ decomposes to $Ta_2O_5$ which bonds well to roughened titanium. These experiments led to the finding that an adherent coating of lead ruthenate; tantalum oxide, 25:75 by weight, could be obtained by firing at 550° C. for 15 minutes. Coatings prepared in this way had excellent surface conductivity and also excellent conductivity from the surface to the reverse side of the titanium substrate.

Samples of the above composition were prepared at loadings of 10 and 20 grams of coating per square meter. When operated as anodes at ambient temperature in a cell containing 220 g $H_2SO_4$/liter and a titanium cathode, the samples passivated within hours. There was no coating loss and surface conductivity was unchanged. Current density was 5 Amps/$in^2$.

Similar samples were operated at ambient temperature in a cell containing 63 g NaCl/liter to produce chlorine at the anode. Cathode was titanium and current density was 5 Amps/$in^2$. At constant voltage, current started to drop after one to two hours, and all samples passivated completely in one to three days. There was no loss of coating or loss of surface conductivity in this electrolyte.

The conclusion from these experiments was that adherent, conductive coatings of lead ruthenate catalyst directly on titanium could be obtained, but that these coatings did not prevent titanium passivation during oxygen or chlorine evolution.

FURTHER PRELIMINARY EXPERIMENTS

Experiments were carried out to determine if anodes having long service life could be made by activating titanium with a small amount of platinum group metals to prevent passivation, and overcoating these with relatively thick coats of $Pb_2Ru_2O_6$:$Ta_2O_5$. An undercoat of Pt:Ir, 70:30 by weight, was selected for this investigation, since this composition, even when used in thin coatings, is known to last for many years in chlorine cells. Samples were prepared by firing in air at 550° C. for 15 minutes, the cycle found earlier to give good adherence of $Pb_2Ru_2O_6$:$Ta_2O_5$ coatings. Samples were loaded in the range of 2 to 6 g/$m^2$ Pt:Ir and at 20 g/$m^2$ $Pb_2Ru_2O_6$:$Ta_2O_5$, 25:75 by weight. The same loadings of Pt:Ir were applied on other samples without lead ruthenate overcoats to determine the effect of overcoats on prevention of passivation.

In $H_2SO_4$, under test conditions described in the preceding section, a loading of Pt:Ir of approximately 4 g/$m^2$ was found necessary to prevent rapid passivation. At this loading, samples without overcoats, passivated in 20 days. Coating loss was measured at intervals and was essentially linear with Amp-hours of operation. When Pt:Ir samples had passivated, typically 90% of original coating had dissolved. This was determined by a beta backscatter method.

When samples used overcoats of $Pb_2Ru_2O_6$:$Ta_2O_5$ in combination with undercoats of 4 g/$m^2$ Pt:Ir, similarly rapid wear rates were found in $H_2SO_4$, but particular combination had very long life, measured in years, in brine. From the results obtained in $H_2SO_4$, the conclusion was that lead ruthenate overcoats do not significantly prevent wear of undercoats of Pt:Ir; time to passivation of composite anodes is determined by amount of Pt:Ir present. When composite coatings passivate, coating loss is close to the amount of Pt:Ir originally present. The lead ruthenate coating has no apparent chemical attack and surface conductivity is retained.

SPECIFIC DESCRIPTION OF THE DRAWING

Figure 1:
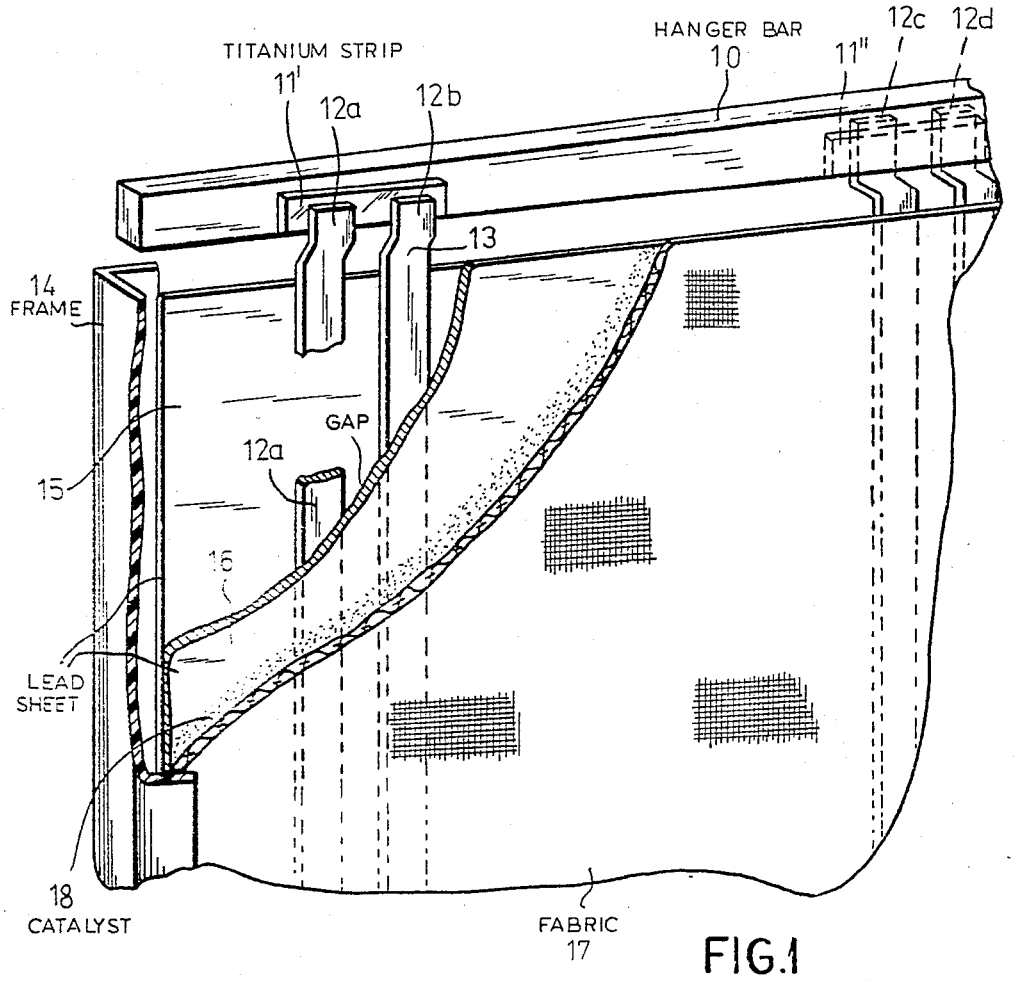
FIG. 1 is a front view perspective, partially cut away, of the anode.

According to FIG. 1, a copper hanger bar 10 (48"×1.75"×0.75") is provided to support the anode. To the copper hanger bar are explosion bonded at least two horizontal titanium strips 11 and 11'. Horizontal titanium strip 11 is bonded to the reverse side of the copper hanger bar as horizontal titanium strip 11'. Should a larger anode be desired, additional horizontal titanium strips may be explosion bonded to the hanger bar alternating between the front and the reverse sides. Each horizontal titanium strip has dimensions of 8"×1.0"×0.063".

As structural supports, vertical titanium strips (36"×2.0"×0.063") **12*a*, 12*b*, 12*c* and 12*d* are provided. To these vertical titanium strips are bonded two sheets of lead or lead alloy 15 and 16 (36"×36"×0.040"). Preferably the lead or lead alloy sheets are explosion bonded to the vertical titanium strips. The explosion bonding is done in alternating fashion in such a way that the vertical titanium strips are offset and parallel when the two lead or lead alloy sheets are brought together with the vertical titanium strips in the center of the sandwich. That is vertical tianium strip 12***a* is bonded to lead or lead alloy sheet 16 and vertical titanium strip 12*b* is bonded to lead or lead alloy sheet 15. Vertical titanium strip 12*a* is spaced two inches apart from vertical titanium strip 12*b*. Similarly vertical titanium strip 12*c* is bonded to lead or lead alloy sheet 16 and vertical titanium strip 12*d* is bonded to lead or lead alloy sheet 15. Also, vertical titanium strip 12*c* is spaced two inches apart from vertical titanium strip 12*d*.

It is important to note that vertical titanium strips 12*a*, 12*b*, 12*c* and 12*d* all lie in the same plane with respect to the lead or lead alloy sheets 15 and 16.

Each of the upper portions of the vertical titanium strips are bent to form an offset 13 in order to facilitate fusion bonding to the horizontal titanium strips 11 and 11'. The fusion bonding of each of the vertical titanium strips to one of horizontal titanium strips 11 or 11' is conventional, using titanium rod, and is done in an atmosphere of pure argon. The lead or lead alloy sheets have a gap of 0.036". A crimping tool is used to force the lead or lead alloy sheets together.

Vertical titanium strips 12*a* and 12*b* are each fusion bonded to horizontal titanium strip 11. Vertical titanium strips 12*c* and 12*d* are each fusion bonded to horizontal titanium strip 11' on the reverse side of the copper hanger bar. Again, should a larger anode be desired and additional horizontal titanium strips are explosion bonded to one or both sides of the copper hanger bar, additional vertical titanium strips can also be provided to be bonded at one end to the lead or lead alloy plates and at the other end to the horizontal titanium strips.

In order to bring the lead ruthenate or lead iridate catalyst 18 into direct contact with the lead or lead alloy sheets 15 and 16, the catalyst is coated on two sheets of cotton cloth each designated 17 and each having dimensions 36"×36", on a single side. The catalyst is coated only on the side of the cotton sheet in contact with the lead or lead alloy sheet. The cotton sheet is then stretched taut to fit securely over the lead or lead alloy sheet. A three-sided rigid, plastic frame 14 is then applied to the bottom of the assembled anode and over the two sides of the anode to be immersed in the metal sulfate electrolyte. The frame 14 holds the two cotton cloths 17 in taut contact with the lead or lead alloy sheets 15 and 16, and it also covers the edge of the two sheets so that there is no direct exposure of lead to the electrolyte. The two opposite sides of the frame are fastened around three edges of the anode using U-shaped plastic fasteners.

Figure 2:
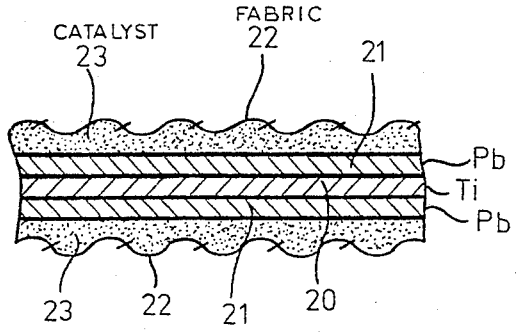
FIG. 2 is a cross sectional view of the anode.

FIG. 2 is a cross-sectional view of the anode per se described in FIG. 1. In the cross-sectional view, the anode has been rotated 90° from FIG. 1. The titanium strips all lined up in the same plane are designated 20. Though these same titanium strips were designated vertical titanium strips in the description of FIG. 1, since the anode in FIG. 2 has been turned on its side, the titanium strips are horizontal. The lead or lead alloy sheets explosion bonded to the respective titanium surfaces in alternating fashion as described in FIG. 1 have been designated each as 21. Each of the cotton cloths held taut to the lead or lead alloy sheets 21 has been designated as 22. Lastly the lead ruthenate or lead iridate catalyst 23 is coated on the inner aspect of each cotton cloth 22 so as to be in direct contact with the lead or lead alloy sheet 21.

EXAMPLE I

Experiments were carried out to determine if lead sheet could be made to contact titanium to prevent passivation. To make the test rigorous, contact between the metals were made only by mechanical means. Current densities of 3 and 5 Amps/in$^2$ were used in 220 g/l $H_2SO_4$. By comparison, in copper refining C.D. is about 25 Amps/ft$^2$ and in zinc electrowinning C.D. is about 60 Amps/ft$^2$.

Samples were prepared by buffing titanium sheet with emery. Lead sheet was laid in contact and then pressed against titanium by tightening titanium nuts and bolts to force a piece of titanium expanded mesh (50% open area) against the lead. Samples made in this way carried current stably for two and three weeks. Power to the cell was shut off for an hour or so about every five days to simulate open circuit conditions in a refinery. When samples passivated, it was found that contact pressure of lead sheet to titanium had lessened because wear of lead surface reduced the pressing force of the titanium mesh. These samples were taken apart, titanium sheet was buffed with emery, and samples reassembled. They again operated normally. Substantial white precipitate, presumably $PbSO_4$, appeared in the cell. When the titanium components of this sample assembly was tested in the cell with lead sheet omitted, passivation occured in seconds.

Several conclusions were drawn from these experiments. There are methods to obtain better electrical contact between lead and titanium. Electroplating baths to deposit pure lead are commercially available and could be used to deposit thin coats of lead on titanium. In turn, these could be used alone or in mechanical contact with lead sheet. Another process, suited to bonding relatively thick sheets of lead directly to titanium, is explosion bonding. This is a commercial method of rapidly joining dissimilar metals by laying them together, placing as explosive charge on one surface, and detonating the charge. This results in a strong mechanical joint having excellent electrical properties.

One commercial application of an explosion bonded electrical joint between titanium and copper is described by Orr and Forrest in U.S. Pat. No. 4,251,337. They use this joint for its mechanical properties as well on cathodes which are used in electrical cells in copper refineries. These explosion bonded joints are continually exposed to hot sulfuric acid and have proved stable for years in a number of copper refineries.

EXAMPLE II

After experiments had shown that lead-titanium joints made by mechanical means gave passivation resistance to titanium for various lengths of time in an accelerated test, methods of attaching lead ruthenate catalyst to one surface of the lead sheet were considered. Lead is a malleable metal and has a low melting point, so the catalyst powder could be attached by forcing it into the lead surface (for example, by metal rolls) or catalyst adherence could be achieved by heating lead sheet just to its softening point. These approaches are not preferred, however, since open circuit conditions might result in lead sulfate formation despite the presence of the catalyst. As lead sulfate spalls off when power is restored, it might carry catalyst with it.

The preferred method of catalyst usage is to apply the powder to one side of a porous cloth, and bring the catalyst coating into contact with lead sheet by mechanical means. This was done experimentally by stretching a porous cotton cloth on a frame. Lead ruthenate powder was slurried in water using a magnetic stirrer. The black slurry was brushed on the white cloth to give an even, black appearance. Loading was approximately 30 $g/m^2$.

The sample was made by buffing titanium sheet with emery, laying lead sheet in contact, placing catalyst on cloth in contact with lead, overlaying cloth with titanium mesh and forcing the assembly together with titanium nuts and bolts. This sample was tested at 3 Amps/$in^2$ in the cell used in Example I. Periodic power interruptions were made to simulate upset conditions. After 10 days operation at stable current, the sample was removed and disassembled. There was no $PbSO_4$ precipitate in the cell but there was a small amount of white material mixed with catalyst on the cloth. This is probably $PbSO_4$ formed during open circuit and retained on the cloth as it subsequently spalled. This suggests that the cloth serves not only as catalyst support but also as a filter to prevent $PbSO_4$ from entering the electrolyte. A fresh catalyst cloth was placed on the lead sheet, the assembly was reassembled and operation resumed at stable current.

Information obtained from experiments described in Examples I and II together with information derived in preliminary experiments, indicated that an oxygen evolution catalyst, lead ruthenate, could be removably contacted to lead sheet and that the lead sheet in turn could be contacted to a titanium substrate to provide an electrowinning anode for use in sulfuric acid. Many variations in catalyst loading, thickness of lead sheet, thickness of titanium and methods of bonding, are possible. Details of a typical design are given below. When the materials described herein are employed in a proper design, it will be obvious to those skilled in the art that an anode having long service life will result. The principal factor determining service life appears to be upset conditions, such as open circuit. Upset frequency will vary widely, but my anode design prevents lead sulfate from entering the electrolyte. If lead sulfate impairs anode operation by plugging the catalyst cloth, a new cloth can be readily installed at the refinery and the used cloth cleansed of $PbSO_4$ or returned for recovery and re-use of catalyst powder.

This anode is expected to have broad application in electrowinning, for example, replacing lead-silver alloy anodes in zinc refineries. It should prove immediately useful in electrorefining of copper, for example, replacing lead-calcium alloy anodes in the starter section where thin sheets of copper are deposited on titanium cathode. The anode of this invention is particularly suited for use in the novel electrowinning cell described by Vining, Scott and Duby in U.S. Pat. No. 4,279,711. They use a membrane to separate a cell into catholyte and anolyte sections. They supply a water miscible alcohol to the anolyte and cause the electrolysis to proceed by oxidation of the alcohol at a much lower voltage than is needed for conventional oxygen evolution.

Obviously, this anode is useful for secondary refining of scrap metals which is similar to electrowinning from ores. Also, this anode is suited to specialized applications in electroplating of copper, nickel and chromium for decorative or protective purposes, where platinized titanium anodes are now employed.

EXAMPLE III

This example is intended to teach how the anode of this invention can be made with economical use of the more expensive materials, titanium and catalyst, and greater use of inexpensive lead sheet. Dimensions chosen for the example are typical of those of lead-calcium alloy anodes used in the starter section of copper refineries.

A copper hanger bar 48"×1.75"×0.75" is provided. To this bar three titanium strips, each 8"×1.0"×0.63" are attached by explosion bonding.

The immersed depth of this anode is 34" and it carries current on both sides. As structural support, six strips of titanium, each 36"×2.0"×0.063" are used. These vertical strips may be designated A,B,C,D,E, and F. To these vertical strips, two sheets of lead, each 36"×36"×0.040" are explosion bonded. This bonding is done in such a way that the titanium strips are offset and parallel when the two lead strips are brought together with titanium strips in the center of the sandwich. That is titanium strip A is bonded to one lead sheet and titanium strip B is bonded to the other sheet and spaced two inches apart from titanium strip A.

The upper portions of the six vertical titanium strips are bent to conform to three horizontal titanium strips explosion bonded to the hanger bar. The bent top portion of each vertical titanium strip is fusion welded to a horizontal titanium strip which is explosion bonded to the hanger bar. This process is conventional using titanium rod and is done in an atmosphere of pure argon. The lead sheets have a gap of 0.063". A crimping tool is used to force the lead sheets together.

At this point in anode construction it can be seen that a workable anode exists but that it has the two disadvantages of solid lead-calcium alloy anodes. Namely that anode voltage is determined by the surface lead dioxide coating and this voltage is higher than is necessary. Lead sulfate will form during open circuit conditions to contaminate the electrolyte and the cathode product. To overcome these two disadvantages, this invention provides two sheets of porous cotton cloth, somewhat larger than 36"×36" each, and each is coated with lead ruthenate catalyst, in an area 36"×36" on a single side. Catalyst coatings are laid in contact with the two 36"×36" lead sheets and the cotton cloths are stretched taut by holding excess sides. A three-sided, rigid plastic frame, similar to a picture frame, is applied over the bottom of the anode and the two sides of the anode to be immersed. This frame holds the two cotton cloths in taut contact with the lead sheets, and it also covers the edges of the two lead sheets so there is no direct exposure of lead to the electrolyte. The two opposite sides of the frame are fastened around three edges of the anode using U-shaped plastic fasteners. See FIGS. 1 and 2 for a further description of the anode.

I claim:

1. An anode for use in electrolytic processes with an electrolyte containing sulfuric acid which comprises:

(a) a valve metal substrate;

(b) a lead or lead alloy antipassivation layer in contact with said valve metal substrate; and (c) a lead ruthenate or lead iridate catalyst in surface contact with the lead or the lead alloy.

2. The anode defined in claim 1 wherein the valve metal is selected from the group consisting of titanium, tantalum, tungsten, niobium, zirconium, and alloys thereof.

3. The anode defined in claim 1 wherein the valve metal is explosion bonded to the lead or lead alloy antipassivation layer.

4. The anode defined in claim 1 wherein the valve metal is mechanically fastened to the lead or lead alloy antipassivation layer.

5. The anode defined in claim 1 further comprising a porous cloth coated with said catalyst, said porous cloth held in surface contact with said lead or lead alloy.

6. The anode defined in claim 5 wherein the catalyst coated porous cloth containing spent or contaminated catalyst is replaced by a fresh catalyst coated porous cloth.

* * * * *